US005944112A

United States Patent [19]

Sundholm

[11] Patent Number: 5,944,112

[45] Date of Patent: Aug. 31, 1999

[54] DRIVE SOURCE FOR FIRE FIGHTING APPARATUS

[76] Inventor: Göran Sundholm, Ilmari Kiannon kuja 3, FIN-04310, Tuusula, Finland

[21] Appl. No.: 09/038,429

[22] Filed: Mar. 11, 1998

[30] Foreign Application Priority Data

Mar. 14, 1997 [FI] Finland ..... 971106

[51] Int. Cl.[6] ..... A62C 35/13; A62C 35/68

[52] U.S. Cl. ..... 169/9; 169/16

[58] Field of Search ..... 169/9, 16

[56] References Cited

U.S. PATENT DOCUMENTS

| | | | |
|---|---|---|---|
| 4,622,209 | 11/1986 | Nardi et al. | 169/9 X |
| 5,657,824 | 8/1997 | Sundholm | 169/9 |
| 5,676,210 | 10/1997 | Sundholm | 169/9 |
| 5,713,417 | 2/1998 | Sundholm | 169/9 X |
| 5,738,174 | 4/1998 | Sundholm | 169/9 X |
| 5,797,457 | 8/1998 | Sundholm | 169/16 X |
| 5,845,713 | 12/1998 | Sundholm | 169/9 |
| 5,845,714 | 12/1998 | Sundholm | 169/16 X |

*Primary Examiner*—Lesley D. Morris

*Attorney, Agent, or Firm*—Ladas & Parry

[57] ABSTRACT

The invention relates to a drive source for a fire fighting apparatus comprising spray heads (4), the drive source comprising a hydraulic accumulator (5), which comprises a container (9, 10) with extinguishing liquid and a pressure gas source (14) for driving the extinguishing liquid out of the container via a channel (29) to the spray heads. To prevent icing of extinguishing liquid in the container (9) and to make the droplet size small, the drive source is characterized in that the container (9) comprises in its lower part an outlet (28) for conducting extinguishing liquid via the channel (29) out to the spray heads (4) of the fire fighting apparatus, and the container (9) is connected to a liquid container (10) having a rising tube (31) in such a way that the rising tube is arranged to conduct extinguishing liquid to a place (33) in the channel (29), whereby the resistance to a liquid flow via the rising tube has been made stronger than the resistance of the channel (29) to the liquid flow, and that the liquid container is connected via a conduit (24, 25) to the pressure gas source (14) in order to obtain gas pressure from the pressure gas source, whereby a nonreturn valve (26) is arranged in the conduit to prevent liquid from flowing from the liquid container to the pressure gas source.

8 Claims, 1 Drawing Sheet

DRIVE SOURCE FOR FIRE FIGHTING APPARATUS

BACKGROUND OF THE INVENTION

The present invention relates to a drive source for a fire fighting apparatus comprising spray heads, the drive source comprising a hydraulic accumulator, which comprises a container with extinguishing liquid and a pressure gas source for driving the extinguishing liquid out of the container via a channel to the spray heads.

Fire fighting apparatuses utilizing sprinklers and spray heads spraying liquid mist have become more and more usual during the last years. The extinguishing medium is water or water containing additives. Such extinguishing medium is not only environmentally friendly, but also capable of extinguishing fires of different types effectively. On account of that the water is sprayed as a mist, the water damages will be minimal. Gas can be mixed with the water mist in order to obtain very finely divided mist, i.e. mist where the size of the water droplets is extremely small.

In order that the fire fighting apparatuses spraying liquid mist may operate effectively, they are normally fed with high pressure. Such a pressure can be obtained from high pressure pumps and pressure gas containers. The pressure gas containers are often preferred, because they can function independently without the need of external energy. On account of this, combinations of liquid containers and pressure gas containers constitute common drive sources in this connection. These drive sources are called hydraulic accumulators.

A problem with liquid containers containing water is the risk of ice formation when the liquid containers are emptied under high pressure. If a rising tube of the water container delivering liquid out of the water container freezes, it can be clogged, whereby the delivery of extinguishing medium is hindered or entirely interrupted.

When hydraulic accumulators are used, the size of the water droplets becomes bigger and bigger toward the end of the emptying process. This is not desirable normally. For that reason, it is known (WO 94/08659) to mix gas with the water delivered out of the water container in order to keep the droplet size small enough.

SUMMARY OF THE INVENTION

The present invention relates to a new drive source for fire fighting apparatuses, which drive source is intended to solve said problems.

The present invention provides a drive source for a fire fighting apparatus comprising spray heads, the drive source comprising a hydraulic accumulator, which comprises a container with extinguishing liquid and a pressure gas source for driving the extinguishing liquid as a liquid flow out of the container via a channel to the spray heads, the channel having a resistance to the liquid flow, wherein the container comprises in its lower part an outlet for conducting the extinguishing liquid via the channel out to the spray heads of the fire fighting apparatus, a liquid container being connected to the container, the liquid container having a rising tube having a resistance to a liquid flow, the rising tube being connected for delivering extinguishing liquid from the liquid container to a place in the channel, whereby the resistance to the liquid flow via the rising tube has been made stronger than resistance to the liquid flow via the channel, and the liquid container is connected via a conduit to the pressure gas source in order to obtain gas pressure from the pressure gas source, a nonreturn valve being arranged in the conduit to prevent liquid from flowing from the liquid container to the pressure gas source.

Preferred embodiments of the invention are presented in the attached claims.

The greatest advantages of the drive source according to the invention are that the risk of icing is overcome in a simple and safe way. Additionally, the consumption of extinguishing liquid becomes low and the droplet size of the liquid mist can be made very small in a simple manner.

BRIEF DESCRIPTION OF THE DRAWINGS

In the following, the invention will be described in more detail with reference to the attached drawing, in which.

DESCRIPTION OF THE PREFERRED EMBODIMENTS

Figure 1:
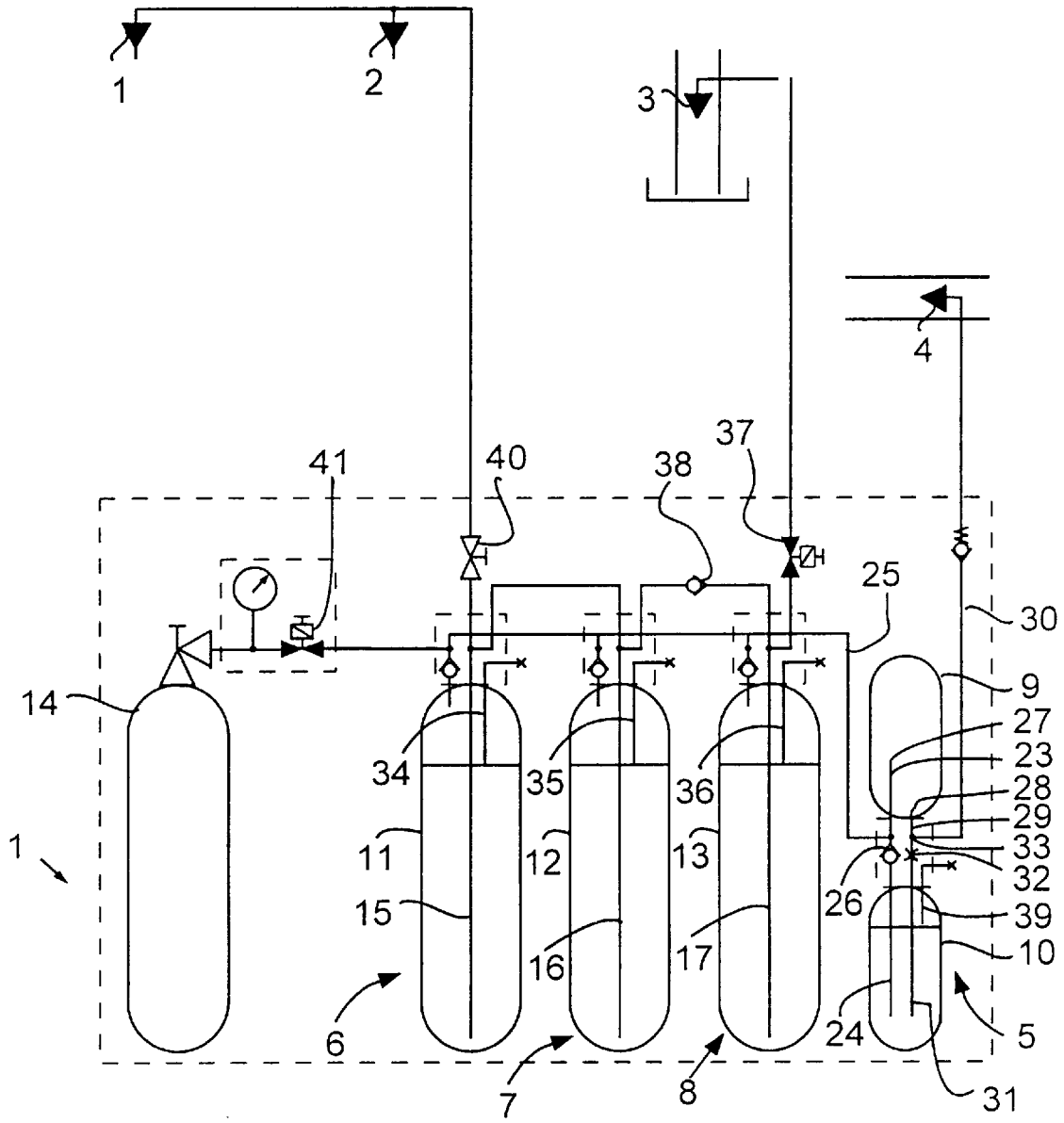
FIG. 1 shows a preferred embodiment of the invention and FIG. 2 shows a detail of FIG. 1.

The drive source of FIG. 1 is connected to heat sensitive sprinklers 1, 2 and to spray heads 3, 4. These sprinklers and spray heads are preferably of such a type that they are capable of producing extinguishing medium in the form of a finely divided liquid mist having a strong penetration and a simultaneous suction in the vicinity of the spray head. Sprinklers of this kind are described in the publications WO 92/20453, WO 92/22353, and WO 94/16771.

The drive source generally indicated by reference numeral 1 comprises four hydraulic accumulators 5, 6, 7, 8. The accumulator 5 comprises two pressure containers 9, 10, each of them having a volume of 10 l. The accumulators 6 to 8 comprise a pressure container 11 to 13, each of them having a volume of 50 l. The pressure containers 9 to 13 contain extinguishing liquid consisting of water-based liquid, i.e. water with or without additives. The number and size of the pressure containers may vary depending on the application.

The pressure containers 11, 12 providing the sprinklers 1, 2 and the pressure container 13 providing the spray head 3 with extinguishing medium are connected to a pressure gas container in the form of a gas bottle 14 having a volume of 50 l. The volume of the gas bottle 14 is selected depending on the application. The gas is nitrogen gas having a pressure of 300 bar. The advantage of using nitrogen consists in that a suitable weight is obtained for the extinguishing medium in such a way that the medium can initially settle against a floor in a fire room, after which the gas component of the extinguishing medium (nitrogen or another incombustible gas having a lower weight than air) later can rise upwards and thus reduce the oxygen content in the room having a fire and thus extinguish the fire or at least have it under control. Instead of nitrogen gas, another incombustible gas can be used, such as argon or carbon dioxide, for example. A gas bottle 14 having different pressures can be used: the typical pressure is 100 to 300 bar before the extinction starts, but a gas bottle within the pressure range between 50 to 100 bar can be used. A pressure of at least about 20 bar is needed for providing a sufficient effect.

Figure 2:
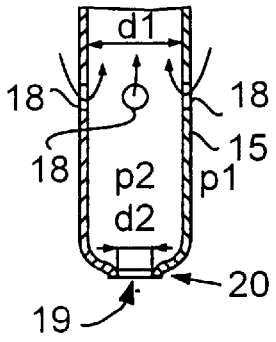

Before use, i.e. before the extinction starts, the pressure containers 11 to 13 are filled with water up to about 80%. The reference numerals 34 to 36 indicate siphon tubes, by means of which the water level in the pressure containers 11 to 13 is initially set at the 80% level. The pressure containers 11 to 13 comprise a rising tube 15 to 17. FIG. 2 shows the lower part of the rising tube 15 of the pressure container 11 enlarged and in greater detail. Reference numeral 38 indicates a nonreturn valve preventing medium from flowing via the rising tubes 15, 16 of the pressure containers 11, 12 into the pressure container 13, but enabling an opposite flow of medium. The rising tube of the pressure containers 12 and 13 is similar. The rising tube 15 comprises at its lower end three side holes 18 such that about 70% of the rising tube is situated above the side holes and about 30% is situated below the side holes. At the very bottom of the rising tube 15, there is a feed opening 19. The lower end of the rising tube 15 is throttled by means of a throttling 20. The throttling 20 is formed at the lower end of the rising tube 15 below the side holes 18 of the rising tube. The throttling 20 is constituted by a constriction in the rising tube 15. The constriction forms a hole having the diameter d2=0.5 mm, while the nominal diameter d1 of the rising tube 15 typically is within the range 8 to 15 mm. The throttling 20 preferably has the diameter d2=0.2 to 4 mm, and most likely 0.3 to 2 mm. Choice of diameter d2 of the throttling 20 depends on many facts, such as type of spray head 1, 2, number of spray heads, drive pressure in the gas bottle 14, type of gas, diameter d1 of the rising tube 15, size and number of the side holes 18, use of the installation, i.e. type of fire to be fighted against.

Reference numeral 40 indicates a manual stop valve.

The pressure containers 9, 10 comprise gas feed tubes 23, 24, via which their content is connected to a conduit 25 for obtaining gas from the gas bottle 14.

Reference numeral 26 indicates a nonreturn valve preventing the fluid from flowing from the pressure container 10 into the gas bottle 14 or the pressure container 9.

Before use, i.e. before the extinction starts, the pressure container 9 is filled with water. The conduit 25 leads to the gas feed tube 23 of the pressure container 9, an inlet 27 of the tube being arranged at a sufficient distance, for instance 20 cm, from an opening 28 at the bottom of the pressure container 9, via which opening water is conducted out of the pressure container into a channel 29 and further into an outlet tube 30 or a conduit leading to the spray head 4. Said distance is necessary in order that no gas may flow into the opening 28 before the pressure container 9 has been emptied of water. The distance shall preferably be at least about 4 cm and typically 10 to 20 cm. The gas feed tube 23 may be omitted, whereby the conduit 25 is arranged to feed gas into the upper part of the container 9.

The pressure container 10 is filled with water up to 60% before the emptying of the container starts. Reference numeral 39 indicates the siphon tube. In the gas space at the upper end of the pressure container, there is nitrogen gas under high pressure, e.g. 180 bar and typically 100 to 200 bar. The pressure container 10 has a rising tube 31 extending from the lower end of the pressure container up to the outlet tube 30. The rising tube 31 is arranged to feed extinguishing liquid to a place 33 in the channel 29. A throttling 32 is arranged in connection with the rising tube 31. If the inner diameter of the rising tube 31 is 6 mm and the inner diameter of the channel 29 is 8 mm, the diameter of the throttling is 0.7 mm. The function of the throttling 32 is to generate a sufficient resistance in the rising tube 31 so that the pressure container 9 is initially emptied of water, after which the emptying of the pressure container 10 can start. A pressure drop of 10 bar over the throttling 32 is typical.

Reference numeral 41 indicates a solenoid valve arranged between the gas bottle 14 and the pressure containers 9 to 13. A smoke detector (not shown) may be connected to the solenoid valve 33 to give a signal to the solenoid valve and to open it. When the valve 33 is opened, nitrogen gas is fed into the pressure containers 11 to 13, in the upper parts of which an initial gas pressure of e.g. 140 bar and a pressure in the container 10 are generated. The gas space in the pressure containers 11 to 13 is about 20% of the volume of the pressure containers and the gas space in the pressure container 10 about 40% of the volume of the pressure container. The nitrogen acts as drive gas for driving water out of the pressure containers 9 to 13. Thanks to the fact that the pressure container 9 has no rising tube for the water, no freezing of water can occur, but the pressure container 9 will be safely emptied of water. Upon the pressure container 9 having been emptied of water, which occurs within some ten seconds, gas starts flowing via the opening 28 into the outlet tube 30, while a little amount of water from the pressure container 10 is mixed with the gas. The water amount is small because of the throttling 32. Instead of a throttling, a rising tube 31 having a sufficiently small inner diameter in comparison to the diameter of the channel 29 can be used. The ratio between the amount of gas and water conducted into the outlet tube 30 is for instance 300:1. This causes that a very fine mist is produced. Ratios between 100:1 and 500:1 are assumed to give a very good result. The gas pressure in the pressure container 10 is the driving force for dosing water via the throttling 32 into the outlet tube 30.

At the same time as the emptying of the pressure container 9 starts, the pressure containers 11, 12 start being emptied in such a way that water flows in through the feed opening 19 of the rising tubes 15, 16 and also through the side holes 18. Simultaneously, or with a predetermined delay by means of a timer affecting the valve 37, the emptying of the pressure container 13 is started.

When the pressure containers 11 to 13 are emptied, the water level therein sinks, whereby the gas volume increases. The proportion of water to gas leaving the rising tube 15 to 17 is determined by the position of the water level in the pressure containers 11 to 13. In the beginning, the side holes 18 and the feed opening 19 via the throttling 20 feed only water into the rising tube. When the liquid level has achieved the level of the side holes 18, and when for example 1 to 3 l water has been sprayed out of the pressure containers 11 to 13, the nitrogen gas begins to mix with the water by means of that nitrogen gas flows through the side holes 18. The gas pressure has then sunk to a value considerably below 140 bar. Because the gas pressure in the pressure containers 11 to 13 has sunk relatively much, the amount of gas needed for obtaining small droplets, for instance 10 to 20 $\mu$m, is relatively big. The droplet size increases when the pressure sinks, if the other parameters remain unchanged. The emptying of the pressure containers 11 to 13 continues until the pressure containers are entirely emptied of water.

Thanks to the throttling 20, a relatively large pressure difference p1-p2 is generated at the side holes 18 from the area outside to the area inside the rising tube 15. This pressure difference, which may be of the size of 50 bar for instance, makes nitrogen gas flow in effectively through the holes 18 after the liquid level in the pressure container 11 has sunk to a level below the side holes 18. On account of the fact that gas can effectively flow into the side holes 18, the result is obtained that the droplet size in the spray coming out of the spray heads 1, 2 and 3 can be made very small, e.g. 10 to 20 $\mu$m and even less than 10 $\mu$m, at the and of the extinction. Because the admixture of gas is effective, it is possible to manage with a small amount of water.

It is clear that side holes can be arranged at different heights of the rising tube 15, whereby it is possible to obtain, by means of the height position and dimension of the side holes, the desired droplet size and consistency of the extinguishing liquid during the emptying process. The throttling is then arranged below the lowest side hole, on account of which a large pressure difference is obtained at all side holes, which is preferable for having a large amount of gas mixed with the liquid. It is, however, conceivable that there are side holes both above and below the throttling 20. However, it is important that the throttling 20 is arranged below the uppermost side hole, whereby a larger pressure difference is obtained at least at this side hole, which difference enables gas to flow in through the side hole after the water level has sunk to the height level of this hole.

The rising tube 15 does not necessarily need to have side openings 18 and a throttling 20.

If the throttling 20 is constituted by a hole having a sufficiently small diameter d2 in comparison to the diameters of the side holes 18, the pressure difference p1-p2 will be very large and liquid can flow in through the side holes. The diameter of the side holes is preferably between 0.5 and 5 mm, and most preferably between 1 and 3 mm. In the embodiment of FIG. 1, the diameter of the side holes is 2 mm.

The invention has above been described with reference to only one example. It shall be observed that details of the invention may vary in many ways within the scope of the attached claims. Accordingly, the throttling of the rising tubes 15 to 17 can alternatively be constructed for instance as a hole made in the wall of the rising tube at the lowest end of the rising tube. The number of side holes in the rising tube can be much bigger than is shown in the figures. It may also be conceivable that there is only one side hole. It shall be pointed out that the gas source does not need to be a pressure gas container.

I claim:

1. Drive source for a fire fighting apparatus comprising spray heads, the drive source comprising a hydraulic accumulator, which comprises a container with extinguishing liquid and a pressure gas source for driving the extinguishing liquid as a liquid flow out of the container via a channel to the spray heads, the channel having a resistance to the liquid flow, wherein the container comprises in its lower part an outlet for conducting the extinguishing liquid via the channel out to the spray heads of the fire fighting apparatus, a liquid container being connected to the container, the liquid container having a rising tube having a resistance to a liquid flow, the rising tube being connected for delivering extinguishing liquid from the liquid container to a place in the channel, whereby the resistance to the liquid flow via the rising tube has been made stronger than resistance to the liquid flow via the channel, and the liquid container is connected via a conduit to the pressure gas source in order to obtain gas pressure from the pressure gas source, a nonreturn valve being arranged in the conduit to prevent liquid from flowing from the liquid container to the pressure gas source.

2. Drive source according to claim 1, wherein the pressure gas source comprises a pressure gas source separate from the container and connected to the container and the liquid container by means of said conduit leading to a container inlet for pressure gas, which inlet is situated at such a distance from the container outlet that gas cannot flow from the inlet into the outlet, before the container at least mostly has been emptied of extinguishing liquid.

3. Drive source according to claim 2, wherein the distance between the inlet and the outlet is at least about 4 cm.

4. Drive source according to claim 1, wherein the resistance of the rising tube is selected such that the proportion between gas and water is 100:1 to 500:1.

5. Drive source according to claim 1, wherein the extinguishing liquid is a liquid based on water and that the pressure gas source is a pressure gas container filled with incombustible gas having a pressure of 20 to 300 bar.

6. Drive source according to claim 5, wherein the pressure gas container contains nitrogen gas.

7. Drive source according to claim 1, wherein the drive source comprises a further accumulator comprising a liquid bottle connected to the pressure gas source, which liquid bottle comprises a rising tube provided with at least one side hole and a feed opening situated at the lower end of the liquid bottle for feeding extinguishing liquid into the rising tube and forward into further spray heads, whereby the rising tube in an area below said at least one side hole comprises a throttling.

8. Drive source according to claim 1, wherein the outlet is at the bottom of the container.

* * * * *